US012035771B2

(12) United States Patent
Polegato Moretti et al.

(10) Patent No.: US 12,035,771 B2
(45) Date of Patent: Jul. 16, 2024

(54) BREATHABLE ITEM OF CLOTHING

(71) Applicant: GEOX S.p.A., Montebelluna (IT)

(72) Inventors: Mario Polegato Moretti, Crocetta del Montello (IT); Marco Bruno, Ivrea (IT)

(73) Assignee: GEOX S.p.A., Montebelluna (IT)

( * ) Notice: Subject to any disclaimer, the term of this patent is extended or adjusted under 35 U.S.C. 154(b) by 43 days.

(21) Appl. No.: 15/734,069

(22) PCT Filed: Jun. 10, 2019

(86) PCT No.: PCT/IB2019/054803
§ 371 (c)(1),
(2) Date: Dec. 1, 2020

(87) PCT Pub. No.: WO2019/239278
PCT Pub. Date: Dec. 19, 2019

(65) Prior Publication Data

US 2021/0361009 A1 Nov. 25, 2021

(30) Foreign Application Priority Data

Jun. 11, 2018 (IT) ..... 102018000006173

(51) Int. Cl.
*A41D 31/102* (2019.01)
*A41B 3/00* (2006.01)

(52) U.S. Cl.
CPC ..... *A41D 31/102* (2019.02); *A41B 3/00* (2013.01)

(58) Field of Classification Search
CPC .... A41D 31/102; A41D 31/065; A41D 31/04; A41D 13/0158; A41D 27/28; A41D 27/285
(Continued)

(56) References Cited

U.S. PATENT DOCUMENTS 1,223,863 A * 4/1917 Freedman ..... A41D 3/04 2/87
2,259,560 A * 10/1941 Glidden ..... A41D 27/28 2/87
(Continued)

FOREIGN PATENT DOCUMENTS

CN 107114829 A 9/2017
DE 20 2017 103 351 U1 8/2017
WO WO 2017/093824 A1 6/2017

OTHER PUBLICATIONS

International Search Report and Written Opinion issued on Jul. 30, 2019 in PCT/IB2019/054803 filed on Jun. 10, 2019.
(Continued)

*Primary Examiner* — Alissa L Hoey
(74) *Attorney, Agent, or Firm* — Oblon, McClelland, Maier & Neustadt, L.L.P.

(57) ABSTRACT

An item of clothing comprising an internal layer, made of vapor-permeable material, which faces the body of the user, an external layer, which is opposite with respect to the internal layer, a hybrid portion, which belongs at least partially to the internal layer and is located in the region of the collar of the item of clothing, and an interspace between the internal layer and the external layer. The item of clothing has at least one open region in the hybrid portion, the hybrid portion being at least partially not in contact with the body of the user.

15 Claims, 4 Drawing Sheets

(58) Field of Classification Search
USPC ..... 2/4
See application file for complete search history.

(56) References Cited

U.S. PATENT DOCUMENTS 2,281,510 A * 4/1942 Neumark ..... A41D 3/02 2/97
2,344,811 A * 3/1944 Gill ..... A42B 1/0187 2/457
2,507,322 A * 5/1950 Smith ..... A41D 3/00 D2/831
2,651,041 A * 9/1953 Sunderland ..... A41D 3/02 2/97
2,682,056 A * 6/1954 Werber ..... A41D 3/00 2/84
2,702,387 A * 2/1955 Wenzel ..... A41D 27/02 2/97
2,771,661 A * 11/1956 Foster ..... D06M 17/00 428/172
3,077,605 A * 2/1963 Salvatore ..... A41D 3/02 2/97
3,213,465 A * 10/1965 Ludwikowski ..... A41D 27/28 2/268
3,698,014 A * 10/1972 Little ..... A41D 3/00 2/202
4,608,715 A * 9/1986 Miller ..... A41D 27/285 2/87
4,716,594 A * 1/1988 Shannon ..... A41D 13/001 2/DIG. 1
5,105,477 A * 4/1992 Golde ..... A41D 27/10 2/93
5,600,850 A * 2/1997 Shannon ..... A41D 13/001 2/69
5,615,416 A * 4/1997 Haddad ..... A41D 3/00 2/202
5,692,245 A * 12/1997 Reuben ..... A41D 27/02 2/243.1
5,704,064 A * 1/1998 van der Sleesen .... A41D 27/28 2/108
5,727,256 A * 3/1998 Rudman ..... A41D 31/14 2/DIG. 1
6,263,510 B1 * 7/2001 Bay ..... A41D 27/28 2/93
6,263,511 B1 * 7/2001 Moretti ..... A41D 27/28 2/93
6,339,843 B1 * 1/2002 Grilliot ..... A62B 17/003 2/8
6,339,845 B1 * 1/2002 Burns ..... A41D 31/102 2/243.1
6,442,760 B2 * 9/2002 Moretti ..... A41D 27/28 2/DIG. 1
6,490,735 B2 * 12/2002 Rindle ..... A41D 27/18 2/129
6,795,976 B1 * 9/2004 van der Sleesen .... A41D 27/28 2/DIG. 1
6,968,573 B2 * 11/2005 Silver ..... A41D 13/02 2/DIG. 1
7,111,328 B2 * 9/2006 Bay ..... A41D 3/00 2/93
7,171,695 B2 * 2/2007 Braun ..... A41D 27/28 2/93
7,540,037 B1 * 6/2009 Bittler ..... A41D 27/28 2/69
8,088,698 B2 * 1/2012 Polegato Moretti ..... A41D 31/145 442/244
8,453,264 B2 * 6/2013 Mickle ..... A41D 27/28 2/82
8,756,714 B2 * 6/2014 Reimer ..... A41D 27/28 2/81
9,474,312 B2 * 10/2016 Ulriksen ..... A41D 31/145
9,635,889 B1 * 5/2017 Copeland ..... A41D 13/0056
9,700,077 B2 * 7/2017 Baron ..... D04B 21/207
10,098,395 B2 * 10/2018 Baschak ..... A41D 27/28
10,159,290 B2 * 12/2018 Fowler ..... A42B 1/048
10,244,804 B2 * 4/2019 Hodgson ..... A41D 3/04
10,455,878 B2 * 10/2019 Rickle ..... F41H 3/00
11,406,148 B2 * 8/2022 Ingram ..... A41D 27/28
2002/0124293 A1 * 9/2002 Zeiler ..... A41D 13/001 2/4
2003/0033656 A1 * 2/2003 Jaeger ..... A41D 27/28 2/93
2004/0132367 A1 * 7/2004 Rock ..... A41D 27/04 442/79
2005/0204448 A1 * 9/2005 Wise ..... D03D 9/00 2/69
2008/0184454 A1 * 8/2008 Collier ..... A41D 1/06 2/243.1
2009/0077710 A1 * 3/2009 Bay ..... A41D 3/00 2/243.1
2009/0176054 A1 * 7/2009 Laib ..... D04H 1/00 156/60
2013/0139296 A1 * 6/2013 Rosenbaum ..... A41D 27/28 2/243.1
2016/0242474 A1 * 8/2016 Baschak ..... A41D 31/102
2017/0079351 A1 * 3/2017 Wang ..... A41D 27/28
2017/0245560 A1 8/2017 Pezzimenti et al.
2018/0098586 A1 * 4/2018 Pezzimenti ..... A41D 27/24
2018/0177248 A1 * 6/2018 Sneath ..... A41D 3/00
2018/0338563 A1 * 11/2018 Moretti Polegato .... B32B 5/026
2019/0110539 A1 4/2019 Moretti Polegato et al.
2020/0015530 A1 * 1/2020 Baker ..... A41D 27/28
2020/0061969 A1 * 2/2020 Okanishi ..... A41D 31/065
2020/0170325 A1 * 6/2020 Mattioni ..... B32B 5/026
2020/0221810 A1 * 7/2020 Polegato Moretti ..... A41D 31/102
2020/0345085 A1 * 11/2020 Iriarte Tineo ..... A41D 27/24
2021/0361008 A1 * 11/2021 Blevins ..... A42B 1/04

OTHER PUBLICATIONS

Chinese Office Action issued in Chinese Patent Application No. 2019800395929 on May 30, 2012, (w/ English translation).

* cited by examiner

BREATHABLE ITEM OF CLOTHING

The present invention relates to a breathable item of clothing.

Items of clothing adapted to facilitate an adequate level of comfort for the user are currently widespread.

In particular, there are items of outerwear, such as jackets, coats and the like, that have measures to allow to remove the heat and evacuate the vapor-phase sweat produced by the body of the user.

Some of such measures use the so-called "stack effect": a natural phenomenon that determines the rise of the heat and of the vapor-phase sweat.

For example, DE202008008210U1, filed by the Vaude company, is known which contains teachings for providing an item of clothing having a plurality of ventilation channels that face the body of the user.

These channels start from the regions of greatest sweat production and extend up to the neck in order to convey the warm air and vapor-phase sweat toward the outside environment.

Such a solution, however, has some drawbacks.

For its correct operation, in fact, the item needs ventilation channels arranged continuously from the regions of greatest sweat production up to the neck.

This aspect forces to use channeled linings which extend on large portions of the item of clothing, with the consequences of stiffening it, of increasing its manufacturing complexity and of limiting the possibility of choice of materials.

Solutions are also known in which the item of clothing comprises exit openings for vapor-phase sweat, on the external surface of the item, in regions that are at the level of the shoulders and on the upper part of the back in order to best use the stack effect.

The openings, in some cases, are also provided with means for retaining outside water or foreign objects, and/or with adjustment means that allow their partial or total opening and closing.

Items provided with openings normally comprise an external layer and an internal layer, between which a padding can be interposed in order to obtain a certain level of thermal insulation.

Usually, the internal layer is constituted by a breathable or perforated fabric, which allows the heat and the vapor-phase sweat to reach the openings located on the external layer and avoid sweat condensation phenomena near the body of the user.

In this manner, the user experiences no feelings of discomfort.

Among these types of solution, EP1194049B1, in the name of the same Applicant, is known for example which contains teachings for the provision of an item of clothing comprising a protective external layer and an internal layer, between which there is an interspace.

On the internal layer there are holes for accessing the interspace for the vapor-phase sweat, while the external layer has, at the top of the item, vapor evacuation holes, combined with means for retaining outside water, impurities or others.

The vapor-phase sweat is channeled into the interspace by stack effect.

Moreover, WO2017/093824, in the name of the same Applicant, is known which contains the teachings for providing an item of clothing having a plurality of air intakes on the external layer which connect the outside environment to the interspace formed between the external layer and the padding.

These air intakes allow the exit of the warm air and of the vapor-phase sweat, and can be located, for example, in the back or cervical region.

Furthermore, U.S. Pat. No. 9,474,312B2, filed by the Helly Hansen company, is known which contains the teachings for providing an item of clothing comprising an external fabric layer with air intakes and ducts that extend substantially in the vertical direction of the item.

In this solution, the air intakes can be selectively closed or opened and there is an air intake at the neck.

However, even this background art has some drawbacks and aspects that can be improved.

The openings present on the external layer, in fact, condition considerably the aesthetics of the item, limiting the choice of materials and making its manufacture complex and awkward.

Furthermore, the openings present on the external layer expose the item to water and dirt coining from outside.

Therefore, means for retaining outside water and dirt are necessary which increase the complexity and the cost for manufacturing the item.

Finally, the openings can be partially or completely obstructed by the presence of a hood, which is arranged at the top of the shoulders and which, when not in use, is folded back with respect to the head of the user and rested on the external fabric of the item.

The hood, in fact, can cover totality or partially the openings located on the external fabric of the item, decreasing their effectiveness. The vapor-phase sweat that is in the space comprised between the external fabric and the internal layer can thus stagnate and condense, generating a general feeling of discomfort for the user.

Likewise, the openings arranged on the external layer can be obstructed if the user uses a neck warmer or a scarf wrapped around the neck, externally to the item of clothing, or a backpack or the like.

Therefore, there is the need to provide an item of clothing that allows to remove the heat and the vapor-phase sweat from the body of the user in order to allow optimum thermoregulation: both if the item comprises an external surface without openings for the exit of the vapor-phase sweat and if the item, although provided with such openings, has them completely or partially obstructed.

The aim of the present invention is to provide an item of clothing that is capable of improving the background art in one or more of the above mentioned aspects.

Within this aim, an object of the invention is to provide an item of clothing capable of ensuring a better dissipation of the heat and of the vapor-phase sweat with respect to those of the known type.

Another object of the invention is to provide an item of clothing that allows ventilation around the body of the user for adequate heat and vapor exchange between the internal microclimate of the item of clothing and the external one, even if the external layer of the item of clothing is without exit openings or if they are completely or partially obstructed.

Another object of the present invention is to provide an item of clothing that is physiologically more comfortable and which, by allowing the natural thermoregulation of the body of the user, allows to keep it dry longer.

Another object of the invention is to provide an item of clothing that is highly reliable, relatively easy to provide and at competitive costs.

This aim and these and other objects that will become better apparent hereinafter are achieved by an item of clothing comprising an internal layer, made of vapor-permeable material, which faces the body of the user, an external layer, which is opposite with respect to said internal layer, a hybrid portion, which belongs at least partially to said internal layer and is located in the region of the collar of said item, and an interspace between said internal and external layers, characterized in that it has at least one open region in said hybrid portion, said hybrid portion being at least partially not in contact with the body of the user.

Further characteristics and advantages of the invention will become better apparent from the description of some preferred but not exclusive embodiments of the item of clothing according to the invention, illustrated by way of non-limiting example in the accompanying drawings, wherein.

Figure 1:
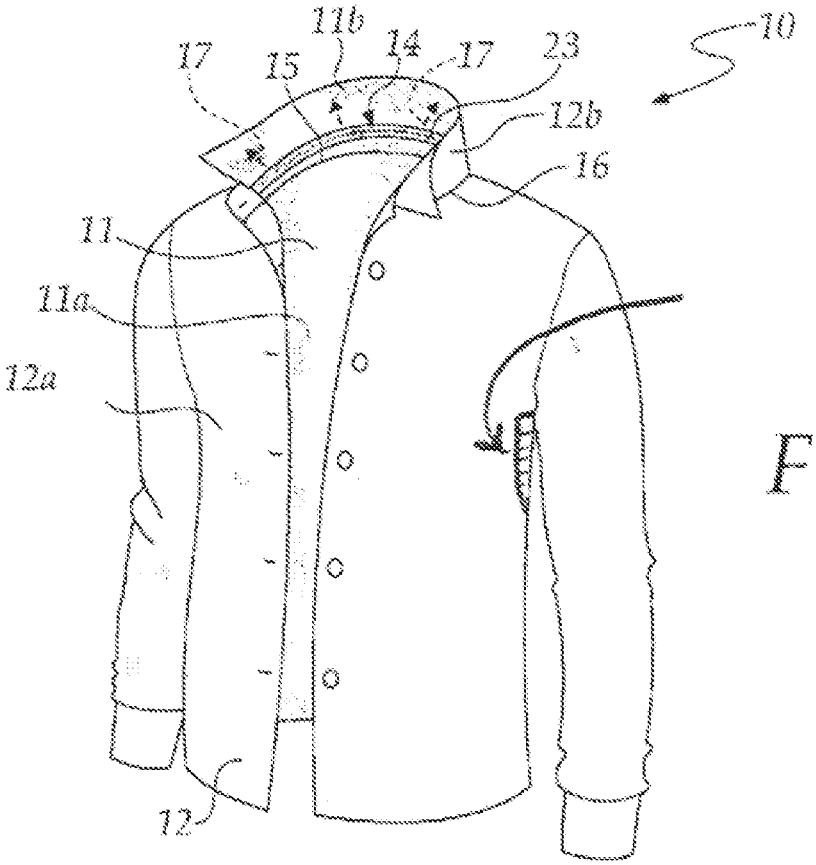
FIG. 1 is a view of an item of clothing according to the invention in a first embodiment thereof.

With reference to the figures, an item of clothing according to the invention, in a first embodiment, is generally designated by the reference numeral 10.

The item of clothing 10 comprises an internal layer 11, which faces the body of the user, and an external layer 12, which is opposite with respect to the internal layer 11.

Advantageously, the external layer 12 is made of per se known impermeable materials.

Between the internal layer 11 and the external layer 12 there is an interspace 13.

The item 10 comprises a hybrid portion 23. Said hybrid portion 23 is arranged in the top of the item 10, in configuration for use, in the region of the collar.

The term "collar" in the present description is understood to reference the part of the item that frames and/or wraps around the neck of the user.

The collar can be made of the same material as the external layer, for aesthetic reasons. In this case, both the internal portion 11*b* of the internal layer 11 and the external portion 12*b* of the external layer 12 are made of the same material.

The hybrid portion 23 belongs at least partially to the internal layer 11.

In some constructive variations, not shown in the figures, the hybrid portion belongs partially to the internal layer and partially to the external layer.

The hybrid portion 23 is at least partially not in contact with the body of the user.

One of the particularities of the invention resides in the presence of an open region or portion 14, in the hybrid portion 23.

The open region 14 is adapted for the exit of the vapor-phase sweat toward the external environment, in the direction indicated by the arrows 17.

A vapor-permeable padding, of a per se known type, not shown in the figures, can be arranged in the interspace 13.

The internal layer 11 and the external layer 12 can comprise multiple portions sewn together.

With reference to FIG. 1, the portion 11*a* of the trunk of the internal layer 11 is joined to the upper portion 11*b* of the item 10, at the collar, by means of a stitched seam 15.

Likewise, the portion 12*a* of the trunk of the external layer 12 is joined to the upper portion 12*b* of the item 10, at the collar, by means of a stitched seam 16.

One of the particularities of the invention resides in that the stitched seam 15 joins different portions of the internal layer 11, but not portions of the external layer 12. The stitched seam 15 for joining multiple portions of the internal layer 11, therefore, does not interact with portions of the external layer 12. In the same manner, the stitched seam 16 joins different portions of the external layer 12, but not portions of the internal layer 11. The stitched seam 16 for joining multiple portions of the external layer 12, therefore, does not interact with portions of the internal layer 11.

Figure 3:
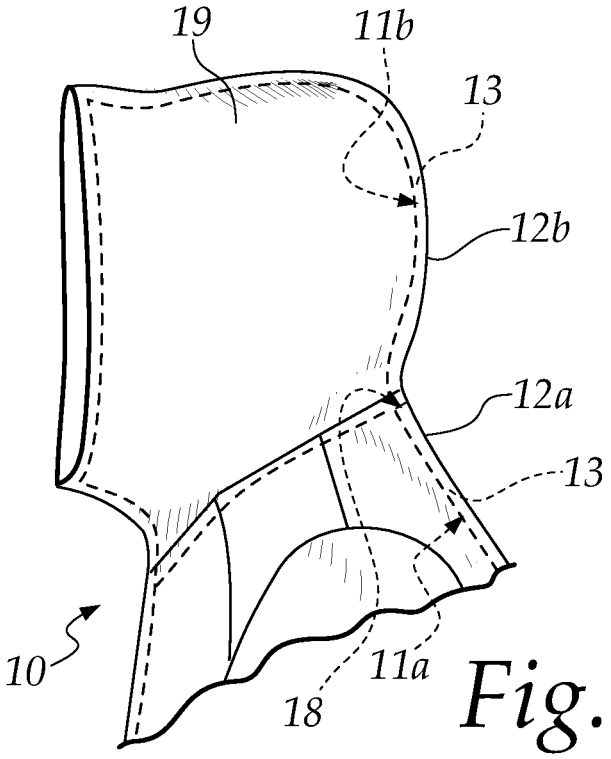
FIG. 3 is a detail view of an item of clothing according to the invention with the detail of FIG. 2.
Figure 4:
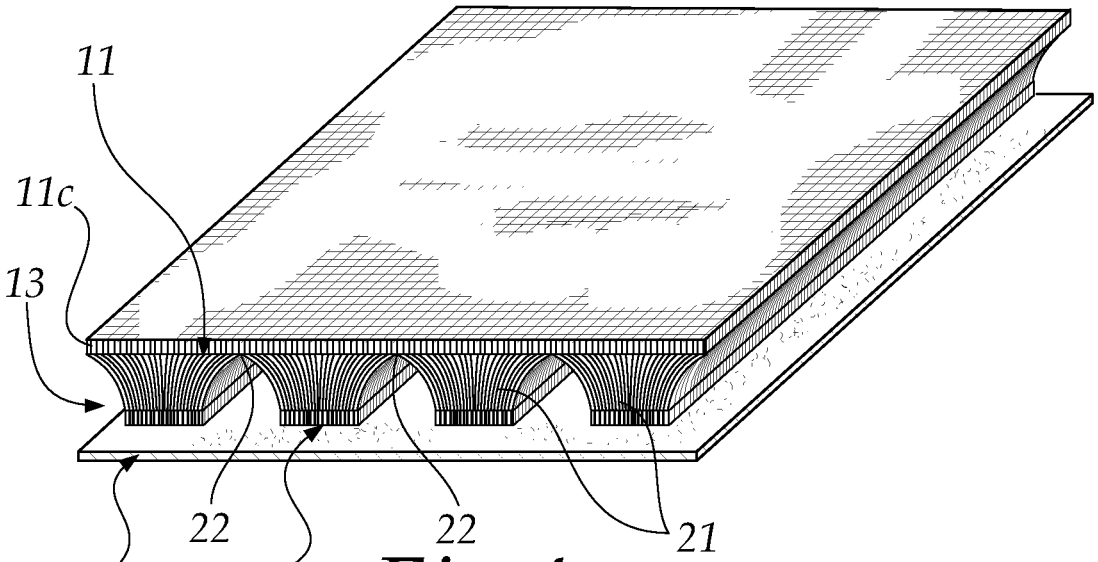
FIG. 4 is a view of a detail of the item of clothing according to the invention.

In this manner, the interspace 13, present between the internal layer 11 and the external layer 12 and shown in FIGS. 3 and 4, does not collapse, since the two layers 11 and 12 are separated.

Figure 2:
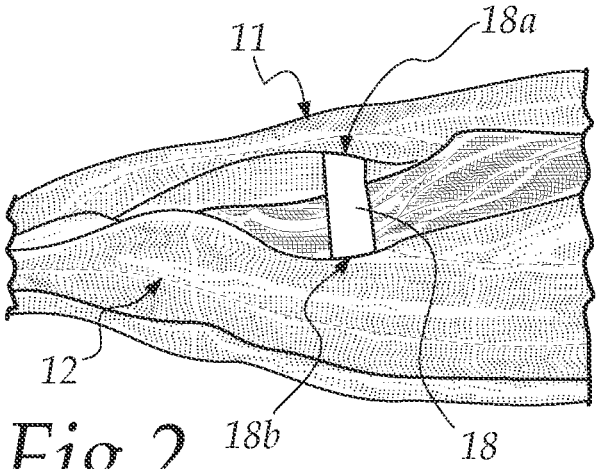
FIG. 2 is a view of a detail of an item of clothing according to the invention.

Advantageously, the item 10 can comprise one or more tapes 18, as shown in FIG. 2.

The tapes 18, for example made of fabric, polymeric material, leather or the like, are applied between the ends of the internal layer 11 and of the external layer 12.

In particular, the end 18*a* of a tape 18 is fixed to an end of the internal layer 11. The other end 18*b* of the tape 18, opposite the previous one, is fixed to the end of the external layer 12, opposite the one of the internal layer 11.

The tape 18 can be fixed to the layers 11 and 12, for example, by means of a stitched seam.

The presence of the tapes 18 allows the coupling between the internal layer 11 and the external layer 12, avoiding an excessive separation thereof.

In doing so, the item 10 maintains an adequate consistency and structure.

With reference to FIG. 3, the item 10 is provided with a hood 19 which is fixed to the external layer 12 by means of stitched seams that do not affect the internal layer 11: this allows to prevent the collapse of the interspace 13. It should be noted that said stitched seams are sufficient to couple the hood 19 to the item 10 also by virtue of the presence of one or more tapes 18 that avoid an excessive separation of the layers 11 and 12.

With reference to FIG. 4, the interspace 13, between the internal layer 11 and the external layer 12, can be determined by the use of spacer means 20, such as for example pins or strips positioned between the two layers 11 and 12.

Advantageously, the spacer means 20 can be also monolithic with the internal layer 11.

In this case, the portion 11*c* of the internal layer 11, having spacer means 20, extends at least over the entire open region 14.

The spacer means 20 are conveniently constituted by a three-dimensional fabric.

The three-dimensional fabric thus determines the presence of the interspace, occupying a volume that is filled, for a non-negligible portion, by air.

The expression "three-dimensional fabric" in the present text is understood to reference a single fabric the component fibers of which are arranged in a mutually perpendicular planar relationship.

In the manufacturing process, in a three-dimensional weaving, the sets of fibers X and Y are woven in with the rows and columns of the axial fibers Z.

The sets of fibers X and Y are, respectively, the horizontal and vertical weft sets. The fibers Z are the multilayer warp set.

It is also possible to obtain three-dimensional fabrics with weaving processes of the two-dimensional type.

Moreover, the three-dimensional fabric can be obtained by knitting on flat or circular knitting machines.

For example, the three-dimensional fabric can have spacer means 20 constituted by a plurality of ribs 21 interlaid with channels 22, or by a needle-tufted fabric and/or a plurality of small tubes.

In an embodiment, the passageway can be wider between adjacent spacer means at a position adjacent the external layer than a position adjacent the internal laver.

The use of the item 10 of clothing according to the invention is as follows.

The vapor-phase sweat and the warm air that are between the body of the user and the item 10 tend to rise by virtue of the stack effect.

A portion of these passes through the internal layer 11, made of vapor-permeable material, and rises inside the interspace 13.

Inside the interspace 13, the vapor-phase sweat rises until it reaches the open region 14 from which it exits toward the external environment, in the direction indicated by the arrows 17.

Vapor-permeability is determined according to the method described in chapter 6.6 of the ISO 20344-2004 standard.

The ISO 20344-2004 standard, in chapter 6.6 "Determination of water vapour permeability", describes a test method consisting in fixing a specimen of the material being tested so as to close the opening of a bottle containing a certain quantity of a solid desiccant, i.e., silica gel.

The bottle is subjected to a strong air flow in conditioned atmosphere and is then rotated so as to stir the solid desiccant and optimize its action of desiccating the air contained in the bottle.

The bottle is weighed both before and after the test period in order to determine the mass of humidity that has passed through the material and has been absorbed by the solid desiccant.

Water vapor permeability, expressed in milligrams per square centimeter per hour [$mg/cm^2 \cdot h$], is then calculated based on the measured mass of humidity, on the area of the opening of the bottle and on the test time.

In this description, "vapor-permeable" and "breathable" are used alternatively, both with the same meaning.

The open region 14 is covered by a layer of breathable and/or perforated material, not shown in the figures.

For example, the open region 14 can be covered by a fabric provided with a greater vapor permeability than the material by which the rest of the internal layer 11 is constituted.

In this manner the exit of the vapor-phase sweat is facilitated.

In a constructive variation, not shown in the figures, the open region 14 is covered, as an alternative or in addition to the layer of breathable or perforated material, by a layer of material that is sensitive to temperature and humidity variations.

This material reacts to an increase in temperature and/or humidity by increasing its own permeability to vapor-phase sweat.

The increase in permeability is due, for example, to a modification of the structure of the material, the pores of which are more open.

In the case of a fabric, instead, the increase in permeability can be due to the widening of the spaces between the threads that compose the warp and weft or between the threads that compose the stitches of knitting.

The vapor permeability of the open region 14 may vary, therefore, according to the vapor and temperature conditions to which is subjected and adapts autonomously to them.

The materials that can be used for this purpose are, for example, fabrics with shape memory polymers or auxetic fabrics, of a per se known type, or the like.

The open region 14 can be at least partially reclosable.

For this purpose, the perimetric edges of the open region 14 can have, for example, zip fastener elements and/or hook and loop means, such as the ones known by the trade name Velcro, and/or buttons and/or the like.

By doing so the user can adjust the open region 14.

For example, in order to contrast an excessive cooling by reducing the escape of heat from the inside of the item 10, the user can partially or completely close the open region 14.

Advantageously, the internal layer 11 has a plurality of secondary open intake regions, not shown in the figures, covered by a layer of breathable and/or perforated material, provided with a greater vapor permeability than the material of which the rest of the internal layer 11 is made.

Such openings are adapted to facilitate the entry of the vapor-phase sweat in the interspace 13.

These secondary openings are conveniently located at the regions with greatest perspiration, such as for example the armpits.

With the localized openings, the vapor-phase sweat is removed quickly and from the outlet from the body of the user, reducing the risk of condensing proximate to his body, thus increasing perceived comfort.

Figure 5:
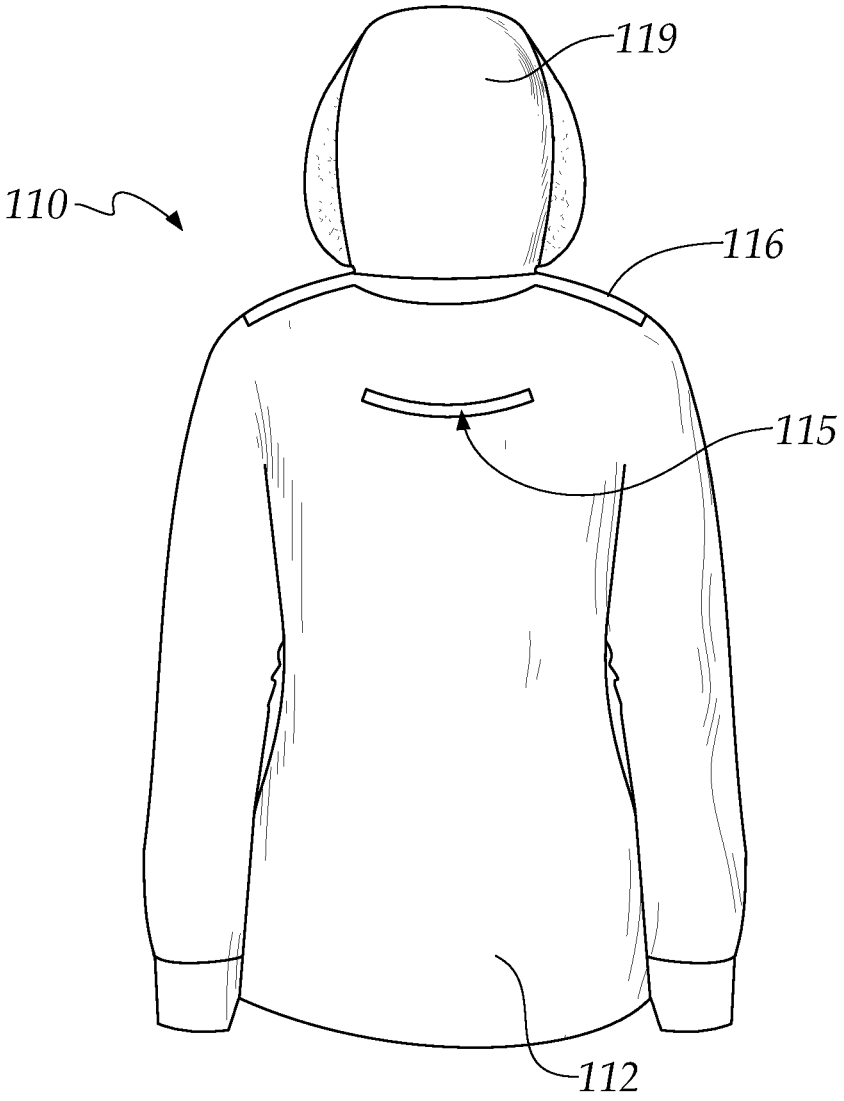
FIG. 5 is a view of an item of clothing according to the invention in a second embodiment.

FIG. 5 shows an item of clothing 110, according to the invention, in a second embodiment.

The item 110 comprises, in a similar manner to the embodiment described above, an internal layer, not shown in the figures, made of a vapor-permeable material and facing the body of the user, an external layer 112, which is opposite with respect to the internal layer, and an interspace which is comprised between the external layer 112 and the internal layer.

The item 110 comprises a region or portion that is open onto the internal layer, not visible in FIG. 5, in the upper portion, in configuration for use, of the item 110, for example, at the dorsal or cervical region or proximate to the shoulders.

One of the particularities of this second embodiment resides in that the external layer 112 has one or more openings.

The openings are adapted to allow the exit of heat and vapor, from the interspace comprised between the internal layer and the external layer 112, directly outside the item 110.

The external layer 112, in the example shown in FIG. 5, has a first opening 115 arranged at the dorsal region and a second opening 116 arranged at the top of the shoulders.

The item 110 is then provided with a hood 119, arranged on the top of the shoulders.

Means for retaining outside water, impurities or others, of a per se known type, can be arranged at the openings 115 and 116.

In this second embodiment it is possible to dissipate heat and vapor through the openings 115 and 116 arranged on the external layer 112 and, partially, through the open region arranged on the internal layer, when the hood 119 is in the configuration for use.

When instead the hood 119 is not in use and is rested on the shoulders and/or back, the heat and vapor are dissipated more by the open region arranged on the internal layer and partially through the openings 115 and 116 of the external layer.

Figure 6:
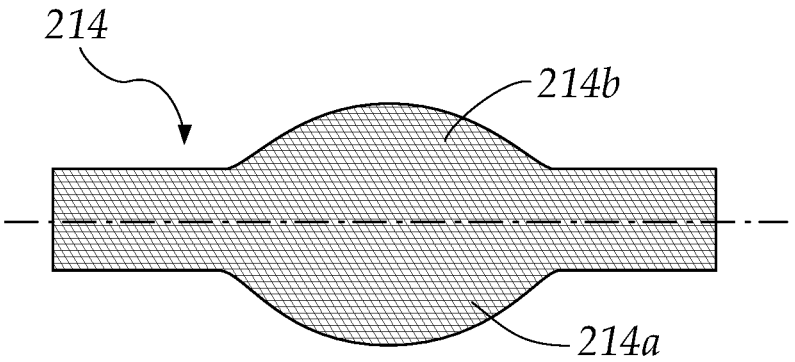
FIG. 6 is a view of a detail of an item of clothing according to the invention in a third embodiment.
Figure 7:
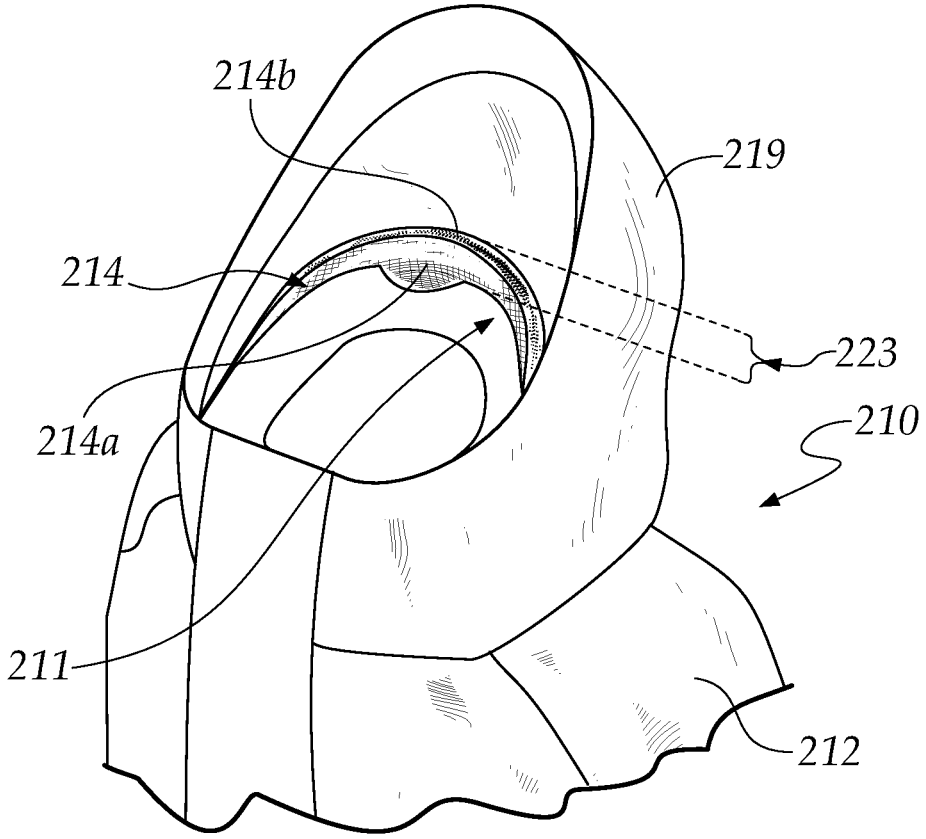
FIG. 7 is a view of an item of clothing according to the invention in a third embodiment.

A third embodiment of an item of clothing 210 according to the invention is shown in FIGS. 6 and 7.

The item 210 comprises, in a manner similar to the previous embodiments, an internal layer 211, made of vapor-permeable material, which faces the body of the user, an external layer 212, which is opposite with respect to the internal layer, a hybrid portion 223, which belongs at least partially to the internal layer 211, in the region of the collar, and an interspace comprised between the external layer 212 and the internal layer 211.

The item 210 comprises an open region 214 in the hybrid portion 223.

In particular, in this third embodiment, the open region 214 comprises a first portion 214*a* and a second portion 214*b* which, in use, are directed respectively toward the user and toward the outside environment.

In this manner, the second portion 214*b* ensures the exit of the vapor-phase sweat even if the first portion 214*a* is too close to the user.

In practice, the open region 214, on the internal layer 211, is arranged on the upper end of the collar.

The collar is then turned toward the outside environment, obtaining the first portion 214*a* of the open region 214 directed toward the user and the second portion 214*b* of the open region 214 directed toward the outside environment.

If necessary, it is then possible to increase the size of the second portion 214*b* with respect to the size of the first portion 214*a*, for example, by turning outward a larger portion of the collar.

In this manner the outflow of the vapor-phase sweat is increased.

In the embodiment shown in FIG. 7, the item of clothing 210 comprises a hood 219; however, the hood might not be present.

It should be noted that in items provided with a hood, when said hood is folded back, it adds its own insulating capacity to that of the item, causing locally an insulation that is greater than the nominal one.

This generates a feeling of discomfort, especially because the insulating capacity of the hood is added at the apical regions of the item, which are the regions in which heat and vapor-phase sweat accumulate.

This phenomenon is more evident in items without exit openings on the external layer.

The open region on the internal layer in the item of clothing of the present invention, instead, allows better thermoregulation because it eliminates the problem of excessive insulation and of the excessive temperature increase inside the item, due to the insulating capacity of said hood.

In a further embodiment, not shown in the figures, the internal layer has more than one open region.

For example, it is possible to provide an item of clothing according to the invention that has two open regions of small dimensions instead of a single open region of such dimensions as to generate a local weakening of the structure.

In practice it has been found that the invention achieves the intended aim and objects by providing a breathable item of clothing that allows ventilation around the body of the user for a suitable exchange of heat and vapor between the internal microclimate of the item of clothing and the external one, even if the external layer of the item of clothing has no exit openings or if they are completely or partially obstructed.

The invention, thus conceived, is susceptible of numerous modifications and variations, all of which are within the scope of the accompanying claims; all the details may furthermore be replaced with other technically equivalent elements.

In practice, the materials used, so long as they are compatible with the specific use, as well as the contingent shapes and dimensions, may be any according to the requirements and the state of the art.

The disclosures in Italian Patent Application no. 102018000006173, from which this application claims priority, are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. An item of clothing comprising:

a collar region located at a region of the item of clothing that is configured to frame and/or wrap around a neck of the user;

an internal layer, made of vapor-permeable material, which is configured to face a body of the user, the internal layer includes a hybrid portion located in the region of the collar of the item of clothing;

an external layer, which is opposite with respect to said internal layer;

an interspace between said internal layer and said external layer; and at least one tape positioned at the collar region, the at least one tape is applied between an end portion of said internal layer and an end portion of said external layer, a first end of the at least one tape is fixed to the internal layer by a stitched seam and a second end of the at least one tape opposite to the first end is fixed to the external layer positioned opposite the internal layer, by a stitched seam so as to avoid an excessive separation between the internal layer and the external layer, wherein the internal layer is closer to the body of the user than the external layer is to the body of the user when worn, the internal layer being directly connected to the external layer by the at least one tape, wherein the hybrid portion includes at least one open region, and wherein the interspace is configured to guide vapor-phase sweat between the internal layer and the external layer to the collar region from below the collar region for release of the vapor-phase sweat to the external environment through the at least one open region of the hybrid portion.

2. The item of clothing according to claim 1, wherein said interspace includes spacer means which are arranged between the internal layer and the external layer.

3. The item of clothing according to claim 2, wherein said spacer means are monolithic with said internal layer.

4. The item of clothing according to claim 1, wherein said open region is covered by a layer of breathable and/or perforated material, which has a higher vapor permeability than the material of which the rest of said internal layer is made.

5. The item of clothing according to claim 1, wherein said open region is covered by a layer of material that is sensitive to temperature and humidity variations.

6. The item of clothing according to claim 1, wherein perimetric edges of said open region include an opening and closing device to allow the open region to be at least partially closed.

7. The item of clothing according to claim 1, wherein said internal layer has a plurality of secondary open regions, which are covered by a layer of breathable and/or perforated material, which has a higher vapor permeability than the material of which the rest of said internal layer is made.

8. The item of clothing according to claim 7, wherein said secondary open regions are located at the regions of higher perspiration.

9. The item of clothing according to claim 1, wherein said open region comprises a first portion and a second portion, wherein during use, the first portion is directed toward the user and the second portion is directed toward the outside environment.

10. The item of clothing according to claim 1, wherein said open region on said internal layer is arranged on an upper end of the collar.

11. The item of clothing according to claim 1, wherein said external layer has at least one opening.

12. The item of clothing according to claim 1, wherein said external layer has a first opening at the dorsal region and a second opening at the top of the shoulders.

13. An item of clothing comprising:

a collar region located at a region of the item of clothing that is configured to frame and/or wrap around a neck of the user;

an internal layer, made of vapor-permeable material, which is configured to face a body of a user, the internal layer includes a hybrid portion located in the region of the collar of the item of clothing;

an external layer, which is opposite with respect to said internal layer; and an interspace between said internal layer and said external layer, wherein the hybrid portion includes at least one open region, wherein said internal layer is constituted by multiple portions joined by a stitched seam and in that said external layer is constituted by multiple portions which are joined by a stitched seam, said stitched seam for mutually joining said portions of said internal layer not directly engaged with portions of said external layer at the collar region, said stitched seam for mutually joining said portions of said external layer not directly engaged with portions of said internal layer at the collar region, and wherein the interspace is configured to guide vapor-phase sweat between the internal layer and the external layer to the collar region from below the collar region for release of the vapor-phase sweat to the external environment through the at least one open region of the hybrid portion.

14. An item of clothing comprising:

a collar region located at a region of the item of clothing that is configured to frame and/or wrap around a neck of the user;

an internal layer, made of vapor-permeable material, which is configured to face a body of the user, the internal layer includes a hybrid portion located in the region of the collar of the item of clothing;

an external layer, which is opposite with respect to said internal layer;

an interspace between said internal layer and said external layer; and at least one tape positioned at the collar region, the at least one tape is applied between an end portion of said internal layer and an end portion of said external layer, a first end of the at least one tape is fixed to the internal layer by a stitched seam and a second end of the at least one tape opposite to the first end, is fixed to the external layer positioned opposite the internal layer, by a stitched seam so as to avoid an excessive separation between the internal layer and the external layer, wherein the internal layer is closer to the body of the user than the external layer is to the body of the user when worn, the internal layer being directly connected to the external layer by the at least one tape, wherein the hybrid portion includes at least one open region, wherein the interspace is configured to guide vapor-phase sweat between the internal layer and the external layer to the collar region from below the collar region for release of the vapor-phase sweat to the external environment through the at least one open region of the hybrid portion, wherein said interspace includes spacer means and channels which are arranged between the internal layer and the external layer, wherein a portion of the internal layer that includes the spacer means, extends at least over an entirety of the open region, and wherein the spacer means is joined to the internal layer, and a width of each channel between adjacent spacer means defines a passageway for the vapor-phase sweat to guide the vapor-phase sweat to the collar region.

15. The item of clothing according to claim 14, wherein the passageway is wider between adjacent spacer means at a position adjacent the external layer than a position adjacent the internal layer.

* * * * *